US007241271B2

(12) United States Patent
Kurata et al.

(10) Patent No.: US 7,241,271 B2
(45) Date of Patent: Jul. 10, 2007

(54) MASSAGE MACHINE

(75) Inventors: Yousuke Kurata, Hikone (JP); Yuki Yoda, Kusatsu (JP); Shinji Tsutsui, Hikone (JP); Masamichi Miyaguchi, Hikone (JP); Takeo Iijima, Hikone (JP); Daisuke Tsukada, Hikone (JP); Takayoshi Tanizawa, Kanzaki-gun (JP); Junji Nakamura, Hikone (JP); Motoharu Muto, Osaka (JP)

(73) Assignee: Matsushita Electric Works, Ltd. (JP)

( * ) Notice: Subject to any disclaimer, the term of this patent is extended or adjusted under 35 U.S.C. 154(b) by 318 days.

(21) Appl. No.: 11/084,141

(22) Filed: Mar. 21, 2005

(65) Prior Publication Data

US 2005/0234371 A1 Oct. 20, 2005

(30) Foreign Application Priority Data

Mar. 26, 2004 (JP) ..... 2004-093366
May 26, 2004 (JP) ..... 2004-156773

(51) Int. Cl.
*A61H 1/02* (2006.01)

(52) U.S. Cl. ..... 601/34; 601/27; 601/148

(58) Field of Classification Search ..... 601/23, 601/24, 27, 33, 34, 35, 133, 134, 148–151; 297/68, 69, 70, 75, 76, 85, 86, 91
See application file for complete search history.

(56) References Cited

U.S. PATENT DOCUMENTS 5,087,094 A * 2/1992 Rogers, Jr. ..... 297/68
5,792,082 A * 8/1998 Yamanaka et al. ..... 601/148
6,517,500 B2 * 2/2003 Ichikawa ..... 601/148
2005/0288612 A1 * 12/2005 Suzuki ..... 601/151

FOREIGN PATENT DOCUMENTS

| | | | |
|---|---|---|---|
| DE | 391 628 | C | 3/1924 |
| EP | 1 201 218 | A2 | 5/2002 |
| JP | 08-052183 | A1 | 2/1996 |
| JP | 09-056766 | A1 | 3/1997 |
| JP | 2001-095867 | A | 4/2001 |
| JP | 2002-238963 | A | 8/2002 |

OTHER PUBLICATIONS

European Search Report mailed on Jul. 6, 2005.

* cited by examiner

*Primary Examiner*—Quang D. Thanh
(74) *Attorney, Agent, or Firm*—Rader, Fishman, & Grauer PLLC

(57) ABSTRACT

This massage machine comprises a seat 20, a leg-rest 50, a footrest 60, an electric extendable mechanism 80, a link mechanism 70, and a controller. The footrest is movably linked to a lower end of the leg-rest to be movable relative to the leg-rest, and is provided with air bags 63 configured to restrain a foot of the user. The electric extendable mechanism and the link mechanism are configured to move the footrest relative to the leg-rest. The controller gives the user a leg stretching mode, and in the leg stretching mode, the controller controls the electric extendable mechanism and the air bags such that the electric extendable mechanism moves the footrest relative to the leg-rest while the air bags restrains the foot of the user.

9 Claims, 5 Drawing Sheets

MASSAGE MACHINE

TECHNICAL FIELD

The present invention relates to a massage machine and, more particularly, to a massage machine which can stretch user's legs.

BACKGROUND ART

Japanese Non-examined Patent Publication No. 9-56766 discloses a massage chair with a leg-rest disposed in front of a seat. The leg-rest is provided with air bags and can give a massage to user's lower thighs by expanding and contracting the air bags. Furthermore, the leg-rest is rotatably linked to a front-end of the seat to be rotatable relative to the seat, and the massage chair can stretch the knees and the thighs of the user by rotating the leg-rest while fixing the user's lower thighs by the air bags.

However, although the massage machine can stretch the user's knees and thighs, it can not stretch the user's ankles.

DISCLOSURE OF THE INVENTION

In view of the above problem, the object of the present invention is to provide a massage machine which can stretch a user's ankle.

The massage machine in accordance with a present invention comprises a seat, a leg-rest for holding a lower thigh of a user, a footrest for holding a foot of the user, a footrest driving means, and a controller. The leg-rest is disposed in front of the seat. The footrest is movably linked to a lower end of the leg-rest to be movable relative to the leg-rest, and is provided with a foot restraining means configured to restrain a foot of the user. The footrest driving means is configured to move the footrest relative to said leg-rest. The controller gives the user a leg stretching mode, and in the leg stretching mode, the controller controls the footrest driving means and the foot restraining means such that the footrest driving means moves the footrest relative to the leg-rest while the foot restraining means restrains the foot of the user.

Therefore, in the leg stretching mode, because the footrest is moved relative to the leg-rest by the footrest driving means while the user's foot is restrained by the foot restraint means, the user's ankle can be stretched adequately.

Preferably, the footrest is configured to be rotatably linked to the lower end of the leg-rest to be rotatable relative to the leg-rest, and the footrest driving means is configured to rotate the footrest relative to the leg-rest, and the controller is configured to control the foot restraining means and the footrest driving means such that, in the leg stretching mode, the footrest driving means rotates the footrest relative to the leg-rest while the foot restraining means restrains the foot of the user. In this case, because the user's foot is rotated relative to the lower thigh, the user's ankle can be stretched efficiently.

More preferably, in the leg stretching mode, the controller controls the footrest driving means such that the footrest driving means rotates the footrest alternately in a direction in which a user's ankle is stretched and in a direction in which the user's ankle is bent and, when rotation direction of the footrest is changed from the direction in which the user's ankle is stretched into the direction in which the user's ankle is bent, the footrest driving means stops rotating the footrest for a predetermined time period. In this case, because a situation where the user's ankle is stretched is maintained for a while, the user's ankle can be stretched more adequately.

It is also preferable that the footrest is configured to be slidably linked to the lower end of the leg-rest to be slidable relative to the leg-rest, and the footrest driving means is configured to slide the footrest relative to the leg-rest, and the controller is configured to control the foot restraining means and the footrest driving means such that, in the leg stretching mode, the footrest driving means slides the footrest relative to said leg-rest while the foot restraining means restrains the foot of the user. In this case, the user's foot is pulled relative to the user's lower thigh, so the user's ankle can be stretched efficiently.

In the above case, it is more preferable that the controller is configured to control the footrest driving means such that, in the leg stretching mode, the footrest driving means slides the footrest alternately in a direction in which an ankle of the user is stretched and in a direction in which the ankle of the user is compressed and, when sliding direction of the footrest is changed from the direction in which the ankle of the user is stretched into the direction in which the ankle of the user is compressed, the footrest driving means stops sliding the footrest for a predetermined time period. In this case, because a situation where the user's ankle is stretched is maintained for a while, the user's ankle can be stretched more adequately.

Preferably, the leg-rest is provided with a lower thigh restraining means configured to restrain a lower thigh of the user, and the controller is configured to control the footrest driving means, the foot restraining means, and the lower thigh restraining means such that, in the leg stretching mode, the footrest driving means moves the footrest relative to the leg-rest while the foot restraining means and the lower thigh restraining means restrain the user's foot and lower thigh, respectively. In this case, the user's foot is moved under a situation where the user's lower thigh, as well as the user's foot, is restrained, so the user's ankle can be stretched more adequately.

Preferably, the leg-rest is configured to be rotatably linked to a front-end of the seat to be rotatable relative to the seat, and the massage machine further comprises a leg-rest driving means configured to rotate the leg-rest relative to the seat, and the controller is configured to control the leg-rest driving means such that, in the leg stretching mode, the leg-rest driving means rotates the leg-rest relative to the seat while the footrest driving means moves the footrest relative to the leg-rest. In this case, because the leg-rest is rotated while the footrest is moved, the user's knee, in addition to the user's ankle, can also be stretched. Further, the user's ankle can be stretched at various angles of the user's leg.

In the above case, preferably, the seat is provided with a thigh restraining means configured to restrain a thigh of the user, and the controller is configured to control the thigh restraining means such that, in the leg stretching mode, the thigh restraining means restrains the thigh of the user while the leg-rest driving means rotates the leg-rest relative to the seat. In this case, because the user's thigh is restrained by the thigh restraining means while the leg-rest is rotated, a gap is not formed between the seat and the undersurface of the user's thigh while the leg-rest is rotated. If the gap is formed between the seat and the undersurface of the user's thigh while the leg-rest is rotated, the user's leg can not be stretched adequately. So, by restraining the user's thigh while rotating the leg-rest, this massage machine can stretch user's leg adequately.

Each of the foot restraint means, the thigh restraint means, and the lower thigh restraint means may comprise an air bag that is expanded and contracted by an air supply and exhaust device.

BEST MODE FOR CARRYING OUT THE INVENTION

Hereinafter, the present invention will be described in more detail with reference to the accompanying drawings.

FIRST EMBODIMENT

Figure 1:
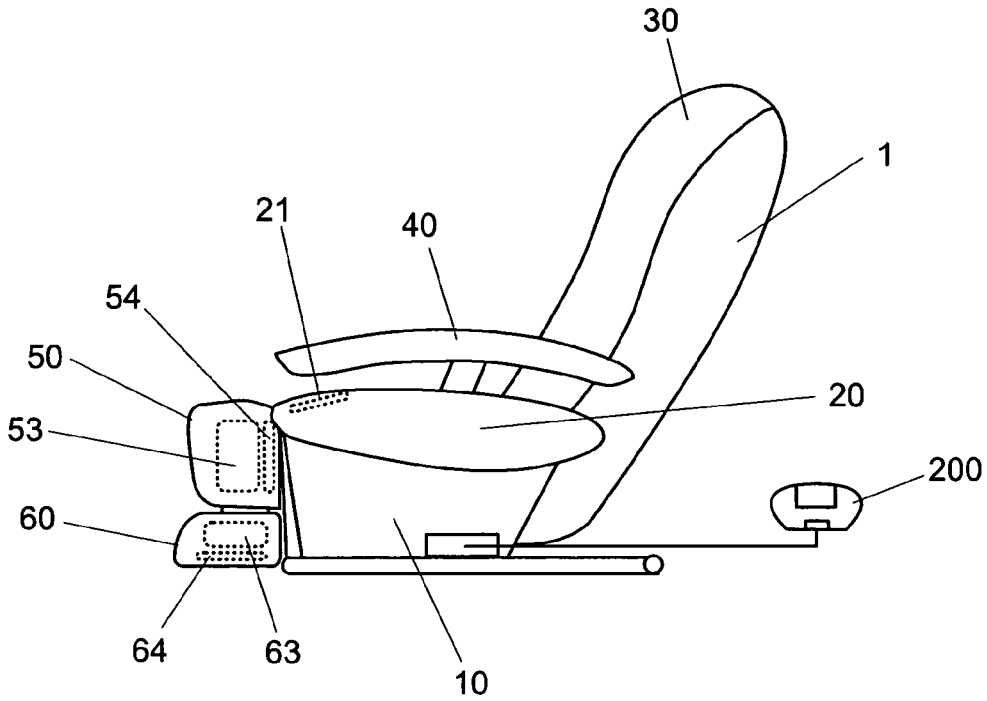
FIG. 1 is a side view of a massage machine in accordance with a first embodiment of the present invention.
Figure 2:
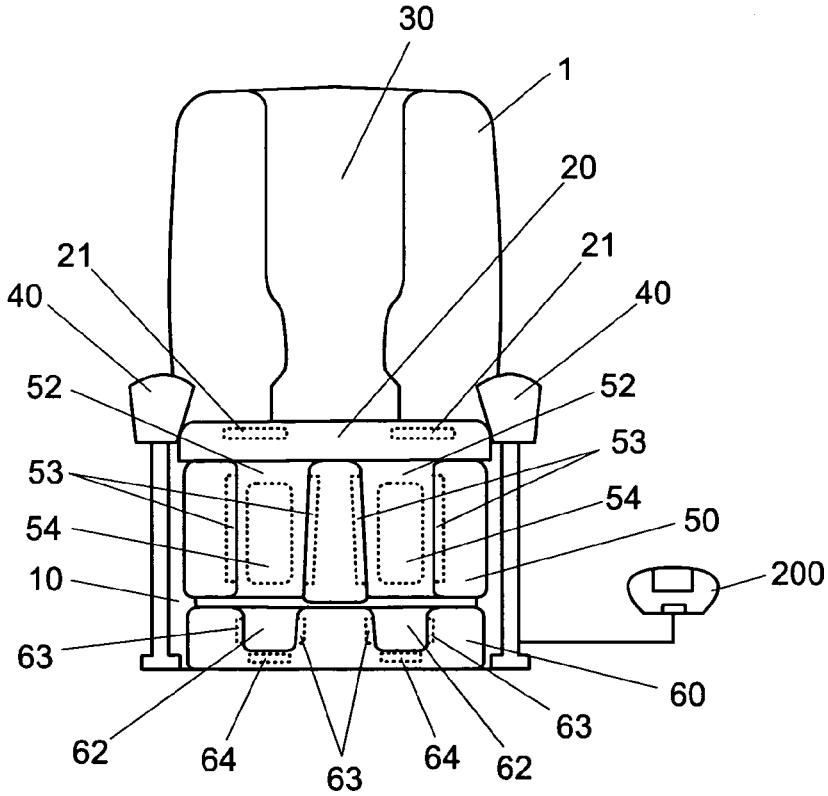
FIG. 2 is a front view of the massage machine of FIG. 1.
Figure 3:
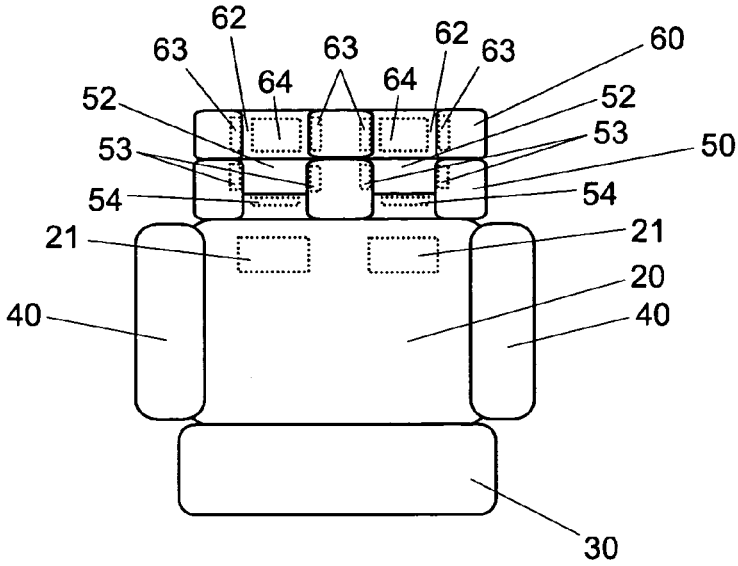
FIG. 3 is a top view of the massage machine of FIG. 1.

FIGS. 1 to 3 show a massage machine 1 in accordance with a first embodiment of the present invention. The massage machine 1 is a chair type massage machine, and comprises a base 10, a seat 20 disposed on the base 10, a reclining backrest 30, armrests 40, a leg-rest 50 for holding user's lower thighs (calves), a footrest 60 for holding the user's feet, and an input device 200. The backrest 30 includes an well-known massage unit 100 (see FIG. 6) which gives a massage to the back, the neck, and the shoulders of the user.

Figure 4:
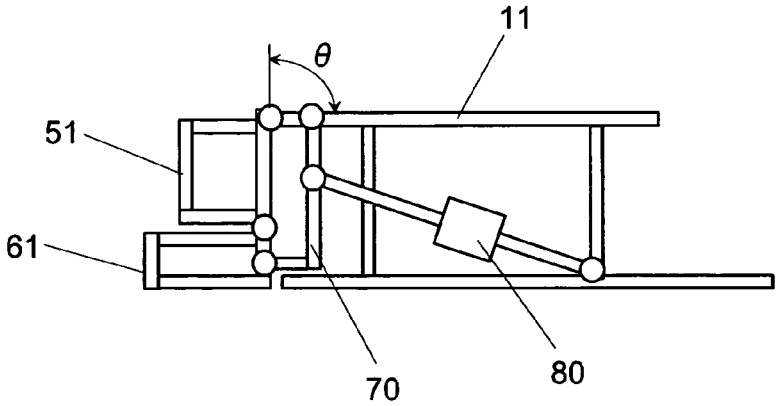
FIGS. 4 to 5 are schematic diagrams of a frame of the massage machine of FIG. 1.

The leg-rest 50 is disposed in front of the seat 20 and is rotatably linked to the front-end of the seat 20 to be rotatable relative to the seat 20. That is, as shown in FIG. 4, a frame 51 of the leg-rest 50 is rotatably linked to a frame 11 of the base 10 at the front-end of the frame 11 to be rotatable relative to the frame 11.

The footrest 60 is rotatably linked to the lower end of the leg-rest 50 to be rotatable relative to the leg-rest 50. That is, as shown in FIG. 4, a frame 61 of the footrest 60 is rotatably linked to the lower end of the frame 51 of the leg-rest 50 to be rotatable relative to the frame 51.

Figure 5:
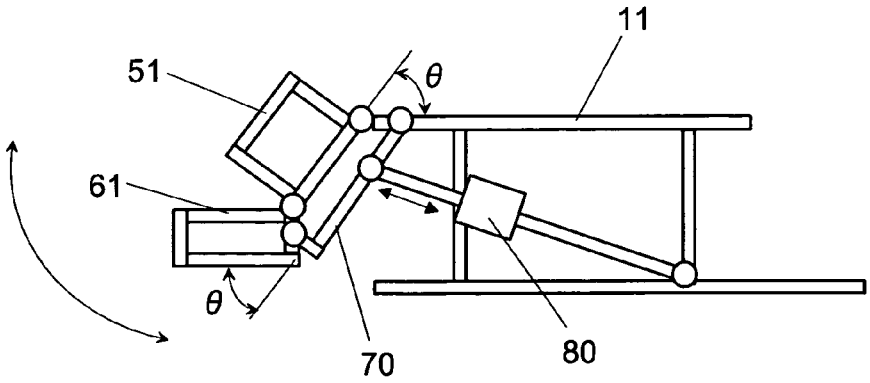

The frame 51 of the leg-rest 50 and the frame 61 of the footrest 60 are linked with a link mechanism 70 connected to the frame 11 of the base 10. The link mechanism 70 is driven by an electric extendable mechanism 80 disposed in the base 10. By a movement of the link mechanism 70 caused by extension and contraction of the electric extendable mechanism 80, the leg-rest 50 can rotate between a vertical position where an angle θ (shown in FIG. 4) which the leg-rest 50 forms with respect to the horizontal direction is nearly 90° and a horizontal position where the angle θ is nearly 0°. And, as shown in FIG. 5, the link mechanism 70 is designed so that the footrest 60 keeps a horizontal condition regardless of the angle θ of the leg-rest 50. Because the footrest 60 keeps the horizontal condition while the leg-rest 50 rotates, the footrest 60 rotates relative to the leg-rest 50 with the rotation of the leg-rest 50. As is clear from the above explanation, in this embodiment, the link mechanism 70 and the electric extendable mechanism 80 constitute a footrest driving means as well as a leg-rest driving means.

Turning back to FIGS. 2 and 3, the leg-rest 50 has two U-shaped grooves 52 for holding the user's lower thighs. Disposed in both side walls of each groove 52 and a bottom of each of the grooves 52 are air bags 53, 54, each of which is expanded and contracted by an air supply and exhaust device 110 (see FIG. 6) provided in the body 10. These air bags 53, 54 can give a massage to the user's lower thighs (calves) by expanding and contracting repeatedly. Furthermore, the air bags 53, disposed in both side walls of each groove 52, can restrain the user's lower thighs by expanding and then pressing each lower thigh of the user from both sides of each groove 52. That is, the air bags 53 constitute a lower thigh restraining means which restrains lower thighs of the user.

The footrest 60 has two U-shaped grooves 62 for holding the feet of the user. Disposed in both side walls of each grooves 62 and an end of each of the grooves 62 are air bags 63, 64, each of which is expanded and contracted by the air supply and exhaust device 110. These air bags 63, 64 can give a massage to the user's feet by expanding and contracting repeatedly. Furthermore, the air bags 63, disposed in both side walls of each groove 62, can restrain the user's feet by expanding and then pressing each foot of the user from both sides of each of the groove 62. That is, these air bags 63 constitute a foot restraining means which restrains feet of the user.

The seat 20 also includes air bags 21, which are expanded and contracted by the air supply and exhaust device 110 to give a massage to the undersurfaces of the user's thighs. Further, these air bags 21 can restrain the undersurfaces of the user's thighs by expanding. That is, these air bags 21 constitute a thigh restraining means which restrains thighs of the user.

Figure 6:
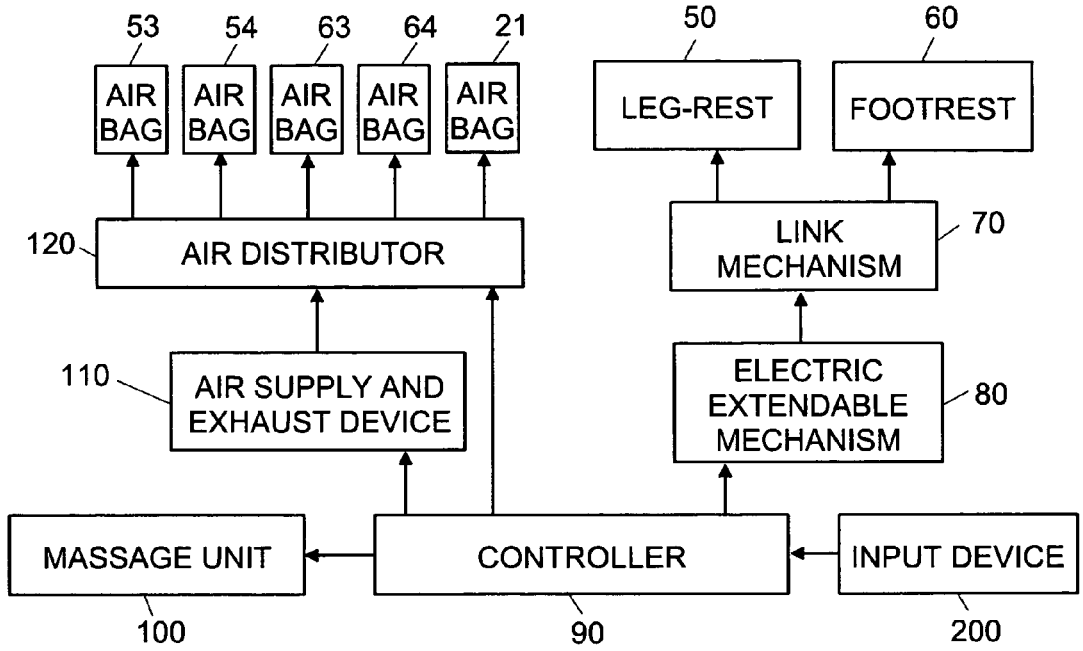
FIG. 6 is a block diagram for explaining a control method of the massage machine of FIG. 1.

Referring to FIG. 6, there is shown a block diagram for explaining a control method of the massage machine 1. As shown in FIG. 6, the massage machine 1 has a controller 90 comprising electronic components, such as a CPU, ROM, and RAM. The controller 90 is disposed in the base 10. The electric extendable mechanism 80, the air supply and exhaust device 110, and an air distributor 120, as well as the well-known massage unit 100, are electrically connected to the controller 90. The leg-rest 50 and the footrest 60 are driven by the electric extendable mechanism 80 through the link mechanism 70, as described above. Each of the air bags 53, 54, 63, 64, and 21 is connected to the air distributor 120, and the air bag(s) specified by the controller 90 is(are) expanded or contracted by the air supply and exhaust device 110 through the air distributor 120.

The controller 90 stores a leg stretching program for stretching the user's legs, in addition to a normal massage program, and, when the user selects a leg stretching mode from the input device 200, the controller 90 gives the user the leg stretching mode based of the leg stretching program.

Hereinafter, the leg stretching mode will be explained in detail.

In the leg stretching mode, first, the controller 90 gives the electric extendable mechanism 80 instructions to rotate the leg-rest 50 until the vertical position shown in FIG. 4. Then, in this vertical position, the controller 90 gives the air supply and exhaust device 100 and the air distributor 120 instructions to expand the air bags 63 disposed in the side walls of each of the grooves 62 of the footrest 60 in order to restrain the feet of the user. Then, keeping the air bags 63 expanded (in other words, keeping the user's feet restrained), the controller 90 gives the electric extendable mechanism 80 instructions to rotate the leg-rest 50 up and down repeatedly. That is, the controller 90 controls the air bags 63 constituting the foot restraining means and the electric extendable mechanism 80 constituting the footrest driving means so that the electric extendable mechanism 80 rotates the footrest 60 relative to the leg-rest 50 through the link mechanism 70 while the air bags 63 keep restraining the user's feet.

As a result, the footrest 60 is rotated repeatedly relative to the leg-rest 50 under a situation where the user's feet are restrained, so the user's ankles are forced to be stretched or bent adequately. Further, because the leg-rest 50 is rotated relative to the seat 20 while the footrest 60 is rotated relative to the leg-rest 50, the user's knees, in addition to the user's ankles, are also stretched.

Figure 7A:
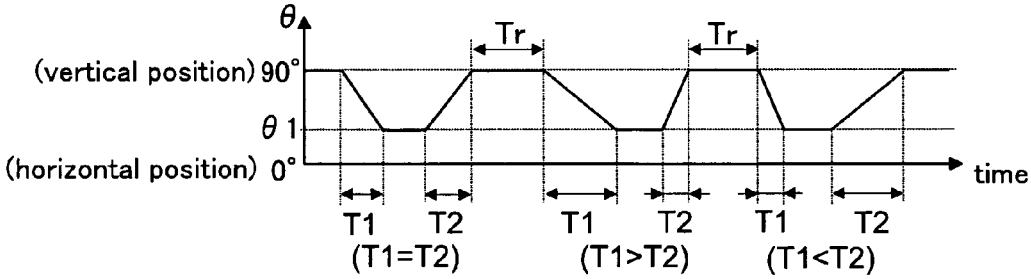
FIGS. 7A to 7C are time charts for explaining a control method of the massage machine of FIG. 1.
Figure 7B:
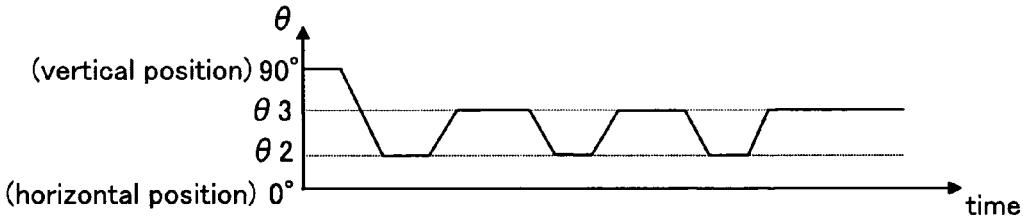
Figure 7C:
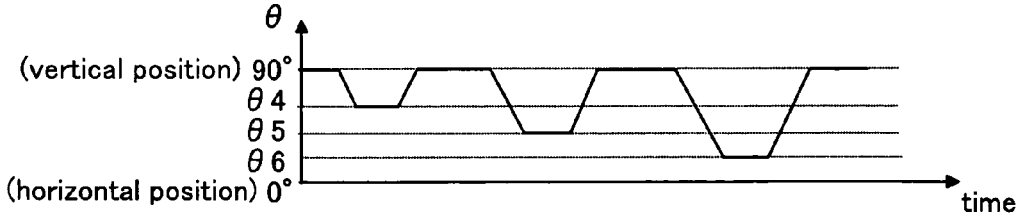

FIGS. 7A to 7C show preferable rotation control methods of the leg-rest 50, in the leg stretching mode.

In FIG. 7A, the controller 90 rotates the leg-rest 50 up and down repeatedly between the vertical position ($\theta=90°$) and a position where the angle $\theta$ of the leg-rest 50 becomes a predetermined angle $\theta 1$. As the leg-rest 50 rotates up and down repeatedly, the footrest 60 rotates relative to the leg-rest 50 alternately in a direction where the ankles (tendons) of the user are bent and in a direction where the ankles (tendons) are stretched. And, when the rotation direction of the footrest 50 is changed from the direction where the ankles (tendons) are stretched into the direction where the ankles (tendons) are bent (in other words, when the rotation direction is switched from a direction in which the angle $\theta$ approaches the vertical position, into a direction in which the angle $\theta$ approaches the horizontal position), the controller 90 stops rotating the leg-rest 50 for a predetermined time period Tr. That is, the controller 90 stops the rotation of the footrest 60 for a predetermined time period Tr. By suspending the rotation of the footrest 60, a state where the user's ankles are stretched is maintained for a while, so that the ankles can be stretched adequately. Furthermore, the controller 90 may change the rotation speed of the footrest 60 (leg-rest 50) to give various stretching patterns to the user. For example, as shown in FIG. 7A, the controller 90 may lengthen a time period T1 in which the leg-rest 50 rotates toward the horizontal position than a time period T2 in which the leg-rest 50 rotates toward the vertical position (that is, $T1>T2$), or the controller 90 may shorten the time period T1 than the time period T2 ($T1<T2$). By changing the stretching pattern, the massage machine 1 can stretch the ankles of the user more efficiently.

Further, as shown in FIG. 7B, the controller 90 may rotate the leg-rest 50 within a predetermined angle range ($\theta 2<\theta<\theta 3$), or as shown in FIG. 7C, the controller 90 may expand the rotation range gradually ($\theta 4<\theta<90° \rightarrow \theta 5<\theta<90° \rightarrow \theta 6<\theta<90°$, wherein $\theta 4>\theta 5>\theta 6$). In these case, the massage machine 1 can reduce a strain which is put on user's joints.

The control method of the controller 90 in the leg stretching mode is not limited to the above method, and the controller 90 may give another stretching patterns to the user. Hereinafter, another control method in the leg stretching mode will be explained.

When the user selects the leg stretching mode using the input device 200, the controller 90 gives the electric extendable mechanism 80 instructions to rotate the leg-rest 50 until the horizontal position. Then, the controller 90 gives the air supply and exhaust device 100 and the air distributor 120 instructions to expand the air bags 21 disposed in the seat 20 to restrain the undersurfaces of the user's thighs. Then, keeping the air bags 21 expanded, the controller 90 gives the air supply and exhaust device 100 and the air distributor 120 instructions to expand the air bags 53 disposed in the leg-rest 50 and the air bags 63 disposed in the footrest 60 in order to restrain the user's lower thighs and feet. Then, keeping the air bags 21, 53, and 63 expanded, the controller 90 gives the electric extendable mechanism 80 instructions to rotate the leg-rest 50 downward. That is, the controller 90 controls the air supply and exhaust device 100, the air distributor 120, and the electric extendable mechanism 80 so that the electric extendable mechanism 80 rotates the leg-rest 50 and the footrest 60 relative to the seat 20 and the leg-rest 50, respectively, through the link mechanism 70 while the air bags 21, 53, and 63 restrain the user's thighs, lower thighs, and feet, respectively.

Then, after maintaining the state where the user's legs are stretched for a while, the controller 90 gives the air supply and exhaust device 100 and the air distributor 120 instructions to contract the air bags 53, 63 to release the user's lower thighs and the feet. And then, the controller 90 gives the electric extendable mechanism 80 instructions to rotate the leg-rest 50 until the horizontal position. When the leg-rest 50 reach the horizontal position, the controller 90 gives the air supply and exhaust device 100 and the air distributor 120 instructions to contract the air bags 21 to release the user's thighs, and finishes a sequence of the leg stretching mode. The controller 90 may repeat the above sequence a predetermined times.

In this control method, because the footrest 60 is rotated relative to the leg-rest 50 while the user's lower thighs as well as the user's feet are restrained, the user's ankle is stretched more adequately. Furthermore, because the leg-rest 50 is rotated relative to the seat 20 while the footrest 60 is rotated relative to the leg-rest 50, the user's knee, in addition to the user's ankle, can also be stretched. Still furthermore, because the user's thighs are restrained while the leg-rest 50 is rotated in a downward direction relative to the seat 20, a gap does not formed between the seat 20 and the undersurfaces of the user's thighs, so the user's knees and ankles are stretched adequately.

The controller 90 may rotate the leg-rest 50 up and down repeatedly while keeping the air bags 21 expanded. That is, after the leg-rest 50 returns to the horizontal position, the controller 90 expands the air bags 53, 63 again to restrain the lower thighs and feet without contracting the air bags 21, and rotates the leg-rest 50 downward again. And, after stretching the user's legs for a while, the controller 90 contracts the air bags 53, 63 to release the user's lower thighs and the feet, as mentioned above, and then rotates the leg-rest 50 until the horizontal position. And, the controller 90 expands the air bags 53, 63 again, and rotates the leg-rest 50 downward.

Figure 8:
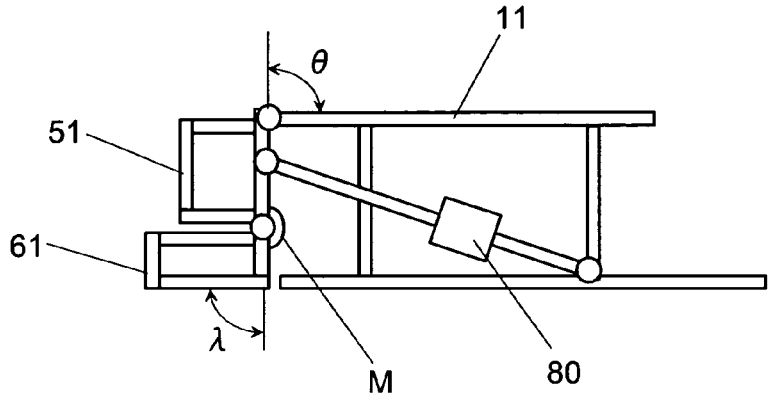
FIG. 8 is a schematic diagram of another construction of the massage machine of FIG. 1.

Although the footrest 60 is rotated by the link mechanism 70 with the rotation of the leg-rest 50 in this embodiment, the footrest 60 may be rotated by a motor M independently of the leg-rest 50, as shown in FIG. 8. In this case, the controller 1 can change an angle $\lambda$ of the footrest 60 with respect to the leg-rest 50, regardless of the angle $\theta$ of the leg-rest 50, so the controller 1 can give more various stretching patterns to the user.

In addition, the massage machine is not limited to the chair type massage machine. For example, the massage machine may be a bed type massage machine which have a berth constituting the seat.

SECOND EMBODIMENT

Figure 9:
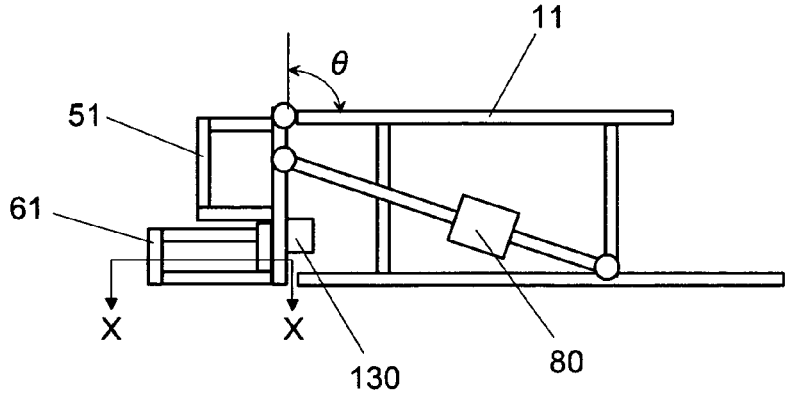
FIGS. 9 to 11 are schematic diagrams of a frame of a massage machine in accordance with a second embodiment of the present invention.
Figure 10:
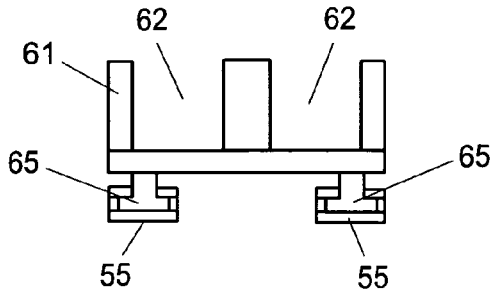
Figure 11:
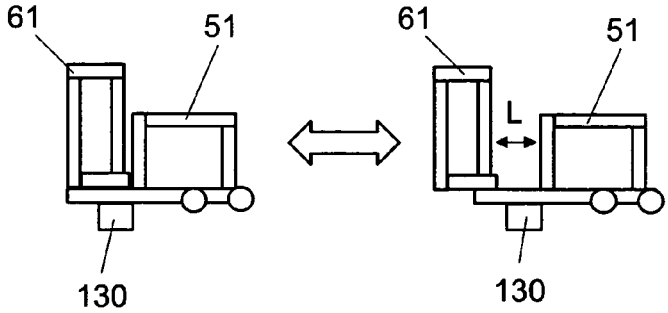

FIGS. 9 to 11 show a massage machine 2 in accordance with a second embodiment of the present invention. The basic composition of this embodiment is identical to the first embodiment, so the similar part of these embodiments are identified by the same reference character and no duplicate explanation is made here.

In the massage machine 2, the footrest 60 is slidably linked to the lower end of the leg-rest 50 to be slidable relative to the leg-rest 50. That is, as shown in FIG. 10, the frame 61 of the footrest 60 has protrusions 65, which are slidably guided by rails 55 provided in the frame 51 of the leg-rest 50. As shown in FIG. 11, the frame 61 is slid by an electric extendable mechanism 130 (or an air-driven extendable mechanism 130), relative to the frame 51 of the leg-rest 50. In this embodiment, the extendable mechanism 130 constitutes the footrest driving means.

As is the case with the first embodiment, the leg-rest 50 is rotated relative to the seat 20 by the electric extendable mechanism 80.

In the leg stretching mode, the controller 90 gives the air supply and exhaust device 100 and the air distributor 120 instructions to expand the air bags 63 disposed in the side walls of each of the grooves 62 of the footrest 60 in order to restrain the feet of the user. Then, keeping the air bags 63 expanded, the controller 90 gives the extendable mechanism 130 instructions to slide the footrest 60 back and forth, relative to the leg-rest 50, repeatedly. Therefore, in this massage machine 2, because the user's feet are pulled relative to the user's lower thigh while the feet are restrained, so the user's ankle is stretched efficiently.

Figure 12A:
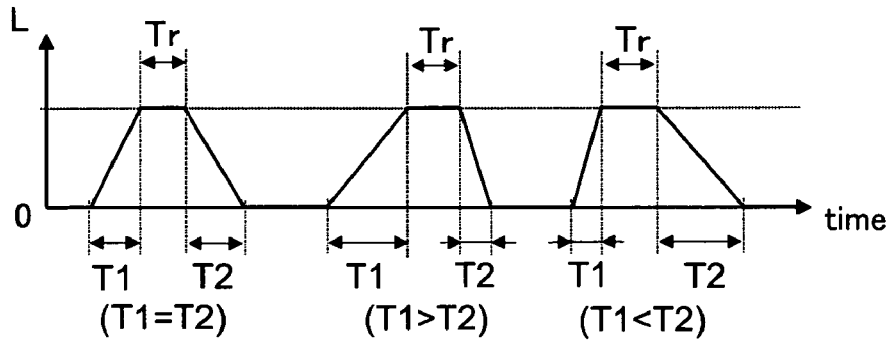
FIGS. 12A to 12C are time charts for explaining a control method of the massage machine of FIG. 9.
Figure 12B:
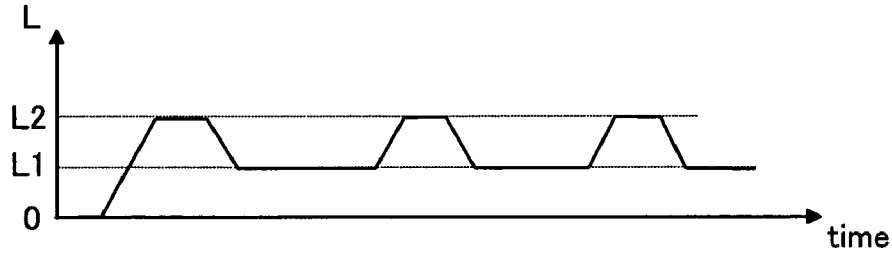
Figure 12C:
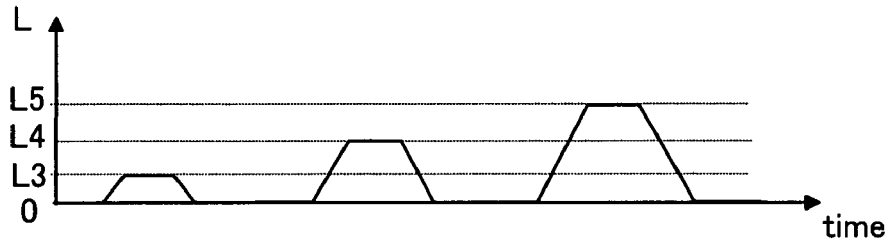

FIGS. 12A to 12C show preferable control methods of the footrest 60, in the leg stretching mode.

In FIG. 12A, the controller 90 slides the footrest 60 alternately in a direction in which an ankle of the user is stretched and in a direction in which the ankle of the user is compressed. And, when sliding direction of the footrest 60 is changed from a direction in which the user's ankles are stretched into a direction in which the user's ankles are compressed, the controller 90 instructs the extendable mechanism 130 to stop sliding the footrest 60 for a predetermined time period Tr. By suspending the slide of the footrest 60, a state where the ankles of the user are stretched is maintained for a while, so the user's ankles are stretched efficiently. Furthermore, the controller 90 may change the sliding speed of the footrest 60 in order to give various stretching patterns to the user. For example, as shown in FIG. 12A, the controller 90 may lengthen a time period T1 in which the user's ankles are stretched than a time period T2 in which the user's ankles are compressed (that is, T1>T2), or the controller 90 may shorten the time period T1 than the time period T2 (T1<T2).

Further, as shown in FIG. 12B, the controller 90 may slide the footrest 60 within a predetermined range (L1<L<L2), or as shown in FIG. 12C, the controller 90 may expand the sliding range gradually (0<L<L3→0<L<L4→0<L<L5, wherein L3>L4>L5). In these case, the massage machine 2 can reduce a strain which is put on user's joints.

In addition, the controller 90 may restrains the user's lower thighs while sliding the user's feet. In this case, the massage machine 2 can stretch the user's feet more adequately. And the controller 90 may slide the footrest 60 while rotating the leg-rest 50 relative to the seat 20. In this case, the user's knees, in addition to the ankles, can be stretched. In the case, the controller 90 may restrain the user's thighs by the air bags 21 while rotating the leg-rest 50.

Or, the controller 90 may slide the footrest 60 after rotating the leg-rest 50 until a predetermined position.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. A massage machine comprising:

a seat;

a leg-rest for holding a lower thigh of a user, said leg-rest being disposed in front of said seat;

a footrest for holding a foot of the user, said footrest being configured to be movably linked to a lower end of said leg-rest to be movable relative to said leg-rest, said footrest being provided with a foot restraining means configured to restrain a foot of the user;

a footrest driving means configured to move said footrest relative to said leg-rest; and a controller configured to give the user a leg stretching mode in which said controller controls said footrest driving means and said foot restraining means such that said footrest driving means moves said footrest relative to said leg-rest while said foot restraining means restrains the foot of the user.

2. The massage machine as set forth in claim 1, wherein said footrest is configured to be rotatably linked to the lower end of said leg-rest to be rotatable relative to said leg-rest, said footrest driving means being configured to rotate said footrest relative to said leg-rest, said controller being configured to control said foot restraining means and said footrest driving means such that, in the leg stretching mode, said footrest driving means rotates said footrest relative to said leg-rest while said foot restraining means restrains the foot of the user.

3. The massage machine as set forth in claim 2, wherein said controller is configured to control said footrest driving means such that, in the leg stretching mode, said footrest driving means rotates said footrest alternately in a direction in which a user's ankle is stretched and in a direction in which the user's ankle is bent and, when rotation direction of said footrest is changed from the direction in which the user's ankle is stretched into the direction in which the user's ankle is bent, the footrest driving means stops rotating said footrest for a predetermined time period.

4. The massage machine as set forth in claim 1, wherein said footrest is configured to be slidably linked to the lower end of said leg-rest to be slidable relative to said leg-rest, said footrest driving means being configured to slide said footrest relative to said leg-rest, said controller being configured to control said foot restraining means and said footrest driving means such that, in the leg stretching mode, said footrest driving means slides said footrest relative to said leg-rest while said foot restraining means restrains the foot of the user.

5. The massage machine as set forth in claim 4, wherein said controller being configured to control said footrest driving means such that, in the leg stretching mode, said footrest driving means slides said footrest alternately in a direction in which an ankle of the user is stretched and in a direction in which the ankle of the user is compressed and, when sliding direction of said footrest is changed from the direction in which the ankle of the user is stretched into the direction in which the ankle of the user is compressed, said footrest driving means stops sliding said footrest for a predetermined time period.

6. The massage machine as set forth in claim 1, wherein said leg-rest being provided with a lower thigh restraining means configured to restrain a lower thigh of the user, said controller being configured to control said footrest driving means, said foot restraining means, and said lower thigh restraining means such that, in the leg stretching mode, said footrest driving means moves said footrest relative to said leg-rest while said foot restraining means and said lower thigh restraining means restrain the user's foot and lower thigh, respectively.

7. The massage machine as set forth in claim 6, wherein said leg-rest is configured to be rotatably linked to a front-end of said seat to be rotatable relative to said seat, said massage machine further comprising a leg-rest driving means configured to rotate said leg-rest relative to said seat, said controller being configured to control said leg-rest driving means such that, in the leg stretching mode, said leg-rest driving means rotates said leg-rest relative to said seat while said footrest driving means moves said footrest relative to said leg-rest.

8. The massage machine as set forth in claim 7, wherein said seat being provided with a thigh restraining means configured to restrain a thigh of the user, said controller being configured to control said thigh restraining means such that, in the leg stretching mode, said thigh restraining means restrains the thigh of the user while said leg-rest driving means rotates said leg-rest relative to said seat.

9. The massage machine as set forth in claim 8, wherein each of said foot restraint means, said lower thigh restraint means, and said thigh restraint means comprises an air bag that is expanded and contracted by an air supply and exhaust device.

* * * * *